US010808347B2

(12) United States Patent
Oh et al.

(10) Patent No.: US 10,808,347 B2
(45) Date of Patent: Oct. 20, 2020

(54) WASHING MACHINE APPLIANCE HAVING A PARTITION ASSEMBLY

(71) Applicant: Haier US Appliance Solutions, Inc., Wilmington, DE (US)

(72) Inventors: Jae Hyun Oh, Seongnam-Si (KR); Tae-Hoon Lim, Seongnam-Si (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 106 days.

(21) Appl. No.: 16/013,040

(22) Filed: Jun. 20, 2018

(65) Prior Publication Data

US 2019/0390387 A1 Dec. 26, 2019

(51) Int. Cl.
*D06F 37/14* (2006.01)
*D06F 37/16* (2006.01)

(52) U.S. Cl.
CPC ..... *D06F 37/16* (2013.01); *D06F 37/145* (2013.01)

(58) Field of Classification Search
CPC ..... D06F 37/145; D06F 37/16
USPC ..... 68/12.19
See application file for complete search history.

(56) References Cited

FOREIGN PATENT DOCUMENTS

| | | | |
|---|---|---|---|
| FR | 2745824 | B1 | 5/1998 |
| GB | 939526 | A | 10/1963 |
| JP | 2015228892 | A | 12/2015 |
| KR | 100186577 | B1 | 5/1999 |
| KR | 20110048124 | A | 5/2011 |

OTHER PUBLICATIONS

Tsuzuki et al., "JP2015228892A English Machine Translation.pdf", Dec. 21, 2015—Machine translation from Espacenet.com.*

* cited by examiner

*Primary Examiner* — Levon J Shahinian
(74) *Attorney, Agent, or Firm* — Dority & Manning, P.A.

(57) ABSTRACT

A washing machine appliance having a partition assembly is provided herein. The washing machine appliance may include a cabinet, a tub disposed within the cabinet, a basket, a partition plate, and a plurality of fluid guides. The basket may be rotatably mounted within the tub. The basket may include a bottom wall and a sidewall defining a chamber for receipt of a load of items for washing. The partition plate may be movably mounted above the bottom wall within the basket. The partition plate may define a first sub-chamber below the partition plate and a second sub-chamber above the partition plate. The plurality of fluid guides may extend along the sidewall below the partition plate within the first sub-chamber.

20 Claims, 13 Drawing Sheets

WASHING MACHINE APPLIANCE HAVING A PARTITION ASSEMBLY

FIELD OF THE INVENTION

The present subject matter relates generally to washing machine appliances, and more particularly to washing machine appliances having features for simultaneously washing different types of articles.

BACKGROUND OF THE INVENTION

Washing machine appliances generally include a tub for containing wash fluid (e.g., water and detergent, bleach, or other wash additives). A basket is rotatably mounted within the tub and defines a wash chamber for receipt of articles for washing. During operation of such washing machine appliances, wash fluid is directed into the tub and onto articles within the wash chamber of the basket. The basket or an agitation element can rotate at various speeds to agitate articles within the wash chamber in the wash fluid, to wring wash fluid from articles within the wash chamber, etc.

Conventional washing machine appliances generally require that a user separate various types of articles before placing them within the wash chamber. For instance, articles made from delicate fabrics, such as silk or linen, must often be separated from articles made from durable fabrics, such as cotton. Washing delicate and durable fabric articles together will usually cause the articles to intermingle. Delicate articles in particular may be damaged by this intermingling (e.g., as a result of pulling or abrasions caused by the durable articles coming into contact with the delicate articles). Moreover, delicate and durable articles generally require different washing operations or cycles to adequately clean the articles. Durable articles in particular may benefit from increased spin speeds or agitation that might otherwise damage delicate articles.

These conventional washing machine appliances present a number of drawbacks. For instance, users are often forced to initiate multiple discrete washing operations to adequately wash delicate articles and durable articles. In other words, multiple loads of laundry must be washed. This may lead to the expenditure and waste of significant amounts of water and energy. The waste may be especially pronounced if each load is relatively small (e.g., smaller than the maximum capacity of the wash chamber). Although some users utilize specialized containers or bags to wash delicate articles with durable articles, many of the above stated concerns would still be at issue. For instance, some intermingling may still occur, and the delicate articles are generally subject to the same agitation as the durable articles being washed at the same time.

As a result, it would be useful to provide a washing machine appliance having one or more features for addressing the issues identified above. In particular, it would be advantageous to have the wash machine appliance wherein delicate articles and durable articles could be safely washed at the same time and in the same washing chamber.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a washing machine appliance is provided. The washing machine appliance may include a cabinet, a tub disposed within the cabinet, a basket, a partition plate, and a plurality of fluid guides. The basket may be rotatably mounted within the tub. The basket may include a bottom wall and a sidewall defining a chamber for receipt of a load of items for washing. The partition plate may be movably mounted above the bottom wall within the basket. The partition plate may define a first sub-chamber below the partition plate and a second sub-chamber above the partition plate. The plurality of fluid guides may extend along the sidewall below the partition plate within the first sub-chamber.

In another exemplary aspect of the present disclosure, a washing machine appliance is provided. The washing machine appliance may include a cabinet, a tub disposed within the cabinet, a basket, a partition plate, and a plurality of fluid guides. The basket may include a bottom wall and a sidewall defining a chamber for receipt of a load of items for washing. The partition plate may be movably mounted above the bottom wall within the basket. The partition plate may define a first sub-chamber below the partition plate and a second sub-chamber above the partition plate. The plurality of fluid guides may extend along the sidewall below the partition plate within the first sub-chamber. The plurality of fluid guides may define a plurality of discrete internal fluid passages extending vertically in fluid communication between the first sub-chamber and the second sub-chamber.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
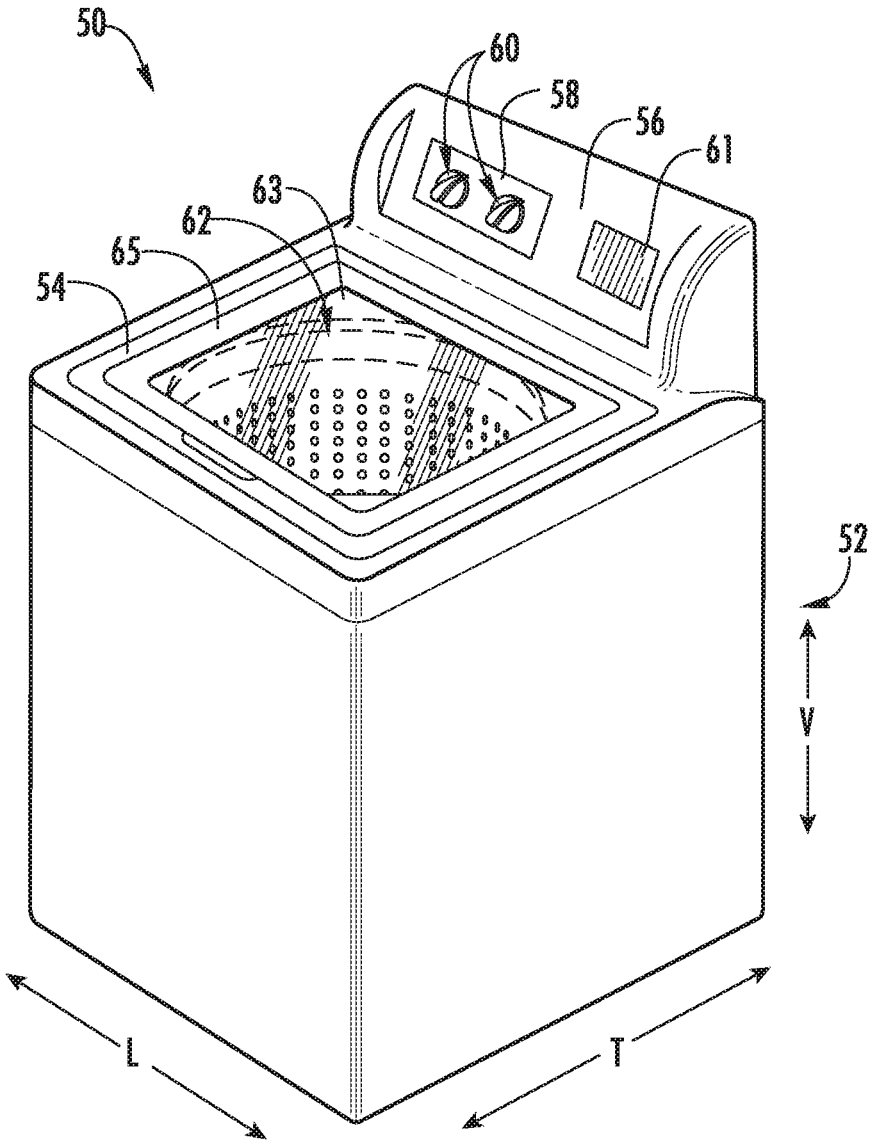
FIG. 1 provides a perspective view of a washing machine appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Within the context of the present disclosure, the terms "includes" and "including" are intended to be inclusive in a manner similar to the term "comprising." Similarly, the term "or" is generally intended to be inclusive (i.e., "A or B" is intended to mean "A or B or both"). The phrase "in one embodiment," does not necessarily refer to the same embodiment, although it may. The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Turning now to the figures, FIG. 1 is a perspective view of a washing machine appliance 50 according to an exemplary embodiment of the present disclosure. As may be seen in FIG. 1, washing machine appliance 50 generally defines a vertical direction V, a lateral direction L, and a transverse direction T. The vertical direction V, lateral direction L, and transverse direction T are each mutually perpendicular and form an orthogonal direction system.

Washing machine appliance 50 includes a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment, a display 61 indicates selected features, a countdown timer, or other items of interest to machine users. A lid 62 is mounted to cover 54 and is rotatable between an open position (not shown) facilitating access to a wash tub 64 (FIGS. 2 and 3) located within cabinet 52 and a closed position (shown in FIG. 1) forming an enclosure over tub 64.

Lid 62 in exemplary embodiment includes a transparent panel 63, which may be formed of for example glass, plastic, or any other suitable material. The transparency of the panel 63 allows users to see through the panel 63, and into the tub 64 when the lid 62 is in the closed position. In some embodiments, the panel 63 may itself generally form the lid 62. In other embodiments, the lid 62 may include the panel 63 and a frame 65 surrounding and encasing the panel 63. Alternatively, panel 63 need not be transparent.

Figure 2:
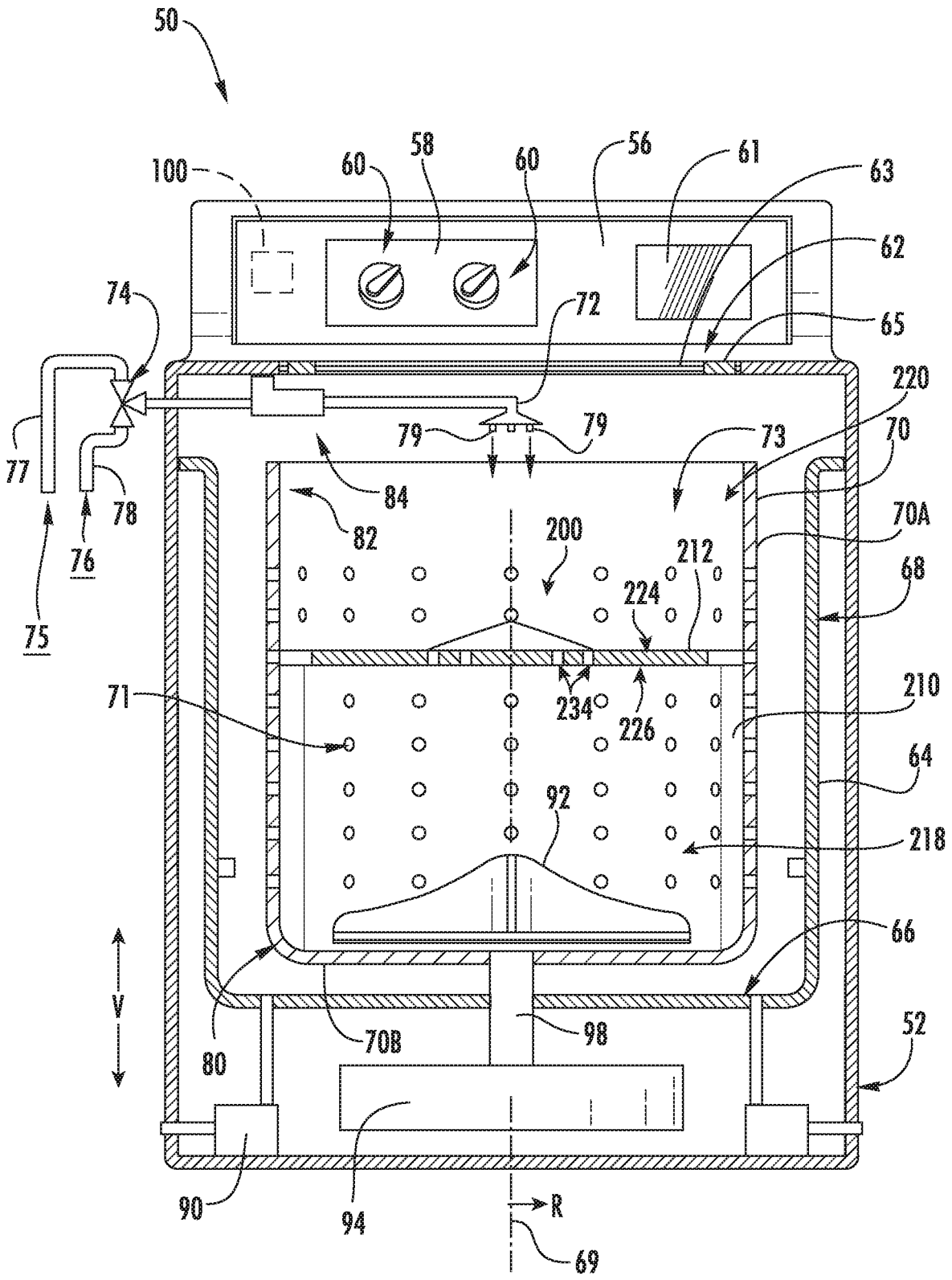
FIG. 2 provides a cross-sectional, side, schematic view of a washing machine appliance according to exemplary embodiments of the present disclosure.
Figure 3:
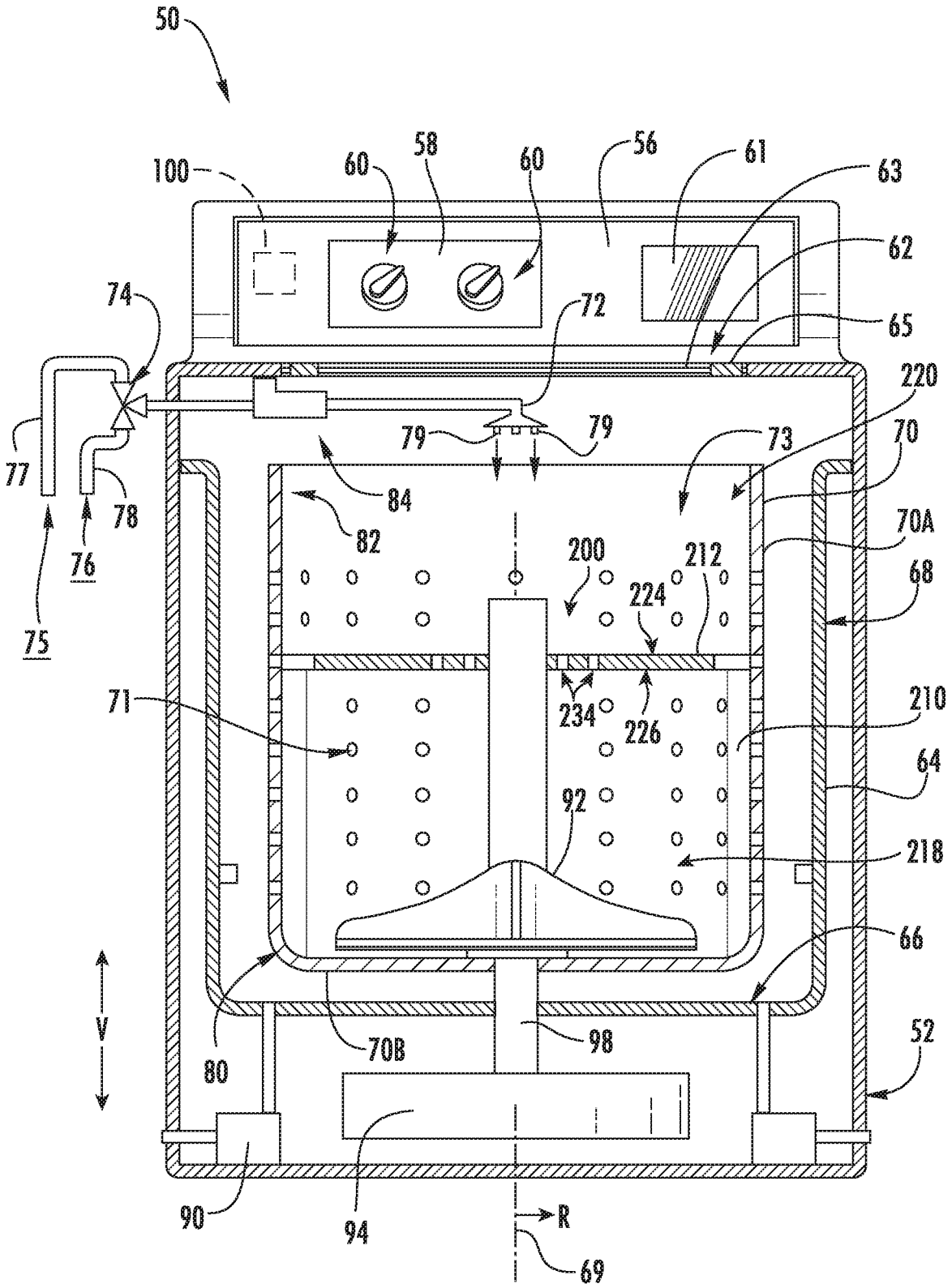
FIG. 3 provides a cross-sectional, side, schematic view of a washing machine appliance according to other exemplary embodiments of the present disclosure.
Figure 4:
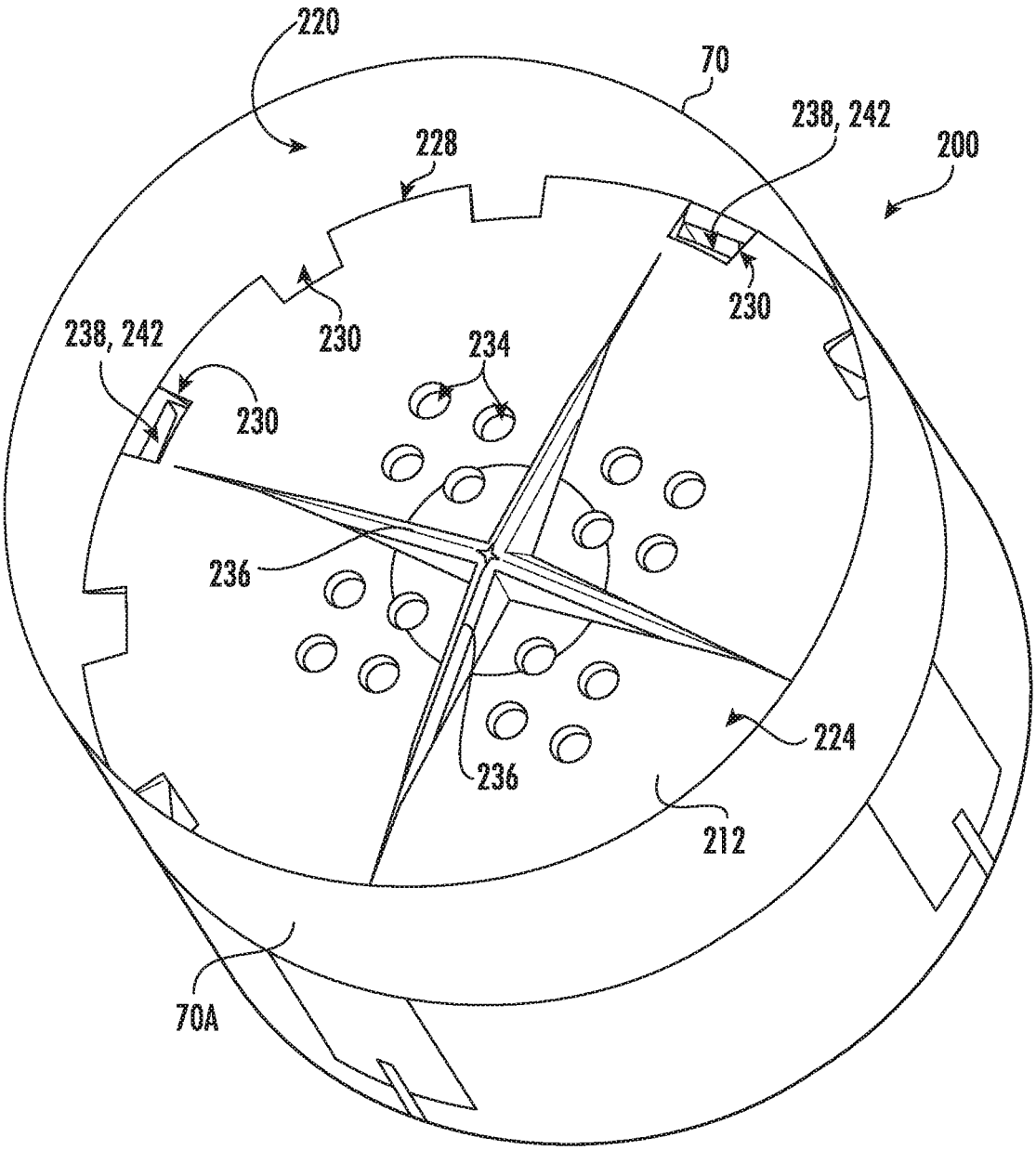
FIG. 4 provides a top perspective view of a tub and partition assembly of a washing machine appliance according to exemplary embodiments of the present disclosure.

FIG. 2 provides a cross-sectional, side, schematic view of washing machine appliance 50 according to one exemplary embodiment. FIG. 3 provides a cross-sectional, side, schematic view of washing machine appliance 50 according to another exemplary embodiment. As shown, tub 64 includes a bottom wall 66 and a sidewall 68. A wash drum or wash basket 70 is rotatably mounted within tub 64. In particular, basket 70 is rotatable about a central axis 69, which may when properly balanced and positioned in the embodiment illustrated be a vertical axis. Thus, washing machine appliance is generally referred to as a vertical axis washing machine appliance. Basket 70 defines a wash chamber 73 for receipt of articles for washing and extends, for example, vertically, between a bottom portion 80 and a top portion 82. Basket 70 includes a plurality of openings or perforations 71 therein to facilitate fluid communication between an interior of basket 70 and tub 64.

A nozzle 72 is configured for flowing a liquid into tub 64. In particular, nozzle 72 may be positioned at or adjacent top portion 82 of basket 70. Nozzle 72 may be in fluid communication with one or more water sources 75, 76 in order to direct liquid (e.g. water) into tub 64 or onto articles within chamber 73 of basket 70. Nozzle 72 may further include apertures 79 through which water may be sprayed into the tub 64. Apertures 79 may, for example, be tubes extending from the nozzles 72 as illustrated, or simply holes defined in the nozzles 72 or any other suitable openings through which water may be sprayed. Nozzle 72 may additionally include other openings, holes, etc. (not shown) through which water may be flowed (i.e. sprayed or poured) into the tub 64.

A valve assembly 74, which may include one or more valves, regulates the flow of liquid through nozzle 72. For example, valve assembly 74 (and each valve thereof) can selectively adjust between a closed position in order to terminate or obstruct the flow of liquid to and through nozzle 72 and an open position in order to allow the flow of liquid to and through nozzle 72. The valve assembly 74 may be in fluid communication with one or more external liquid sources, such as a cold water source 75 and a hot water source 76. The cold water source 75 may, for example, be a commercial water supply, while the hot water source 76 may be, for example, a water heater. Such external water sources 75, 76 may supply water to the appliance 50 through the valve assembly 74. A cold water conduit 77 and a hot water conduit 78 may supply cold and hot water, respectively, from the sources 75, 76 through valve assembly 74. Valve assembly 74 may further be operable to regulate the flow of hot and cold liquid, and thus the temperature of the resulting liquid flowed into tub 64, such as through the nozzle 72. For example, in some embodiments, valve assembly 74 includes a single valve which is in fluid communication with both the cold water source 75 (via cold water conduit 77) and the hot water source 76 (via hot water conduit 78). In alternative embodiments, valve assembly 74 may include a valve which is in fluid communication with the cold water source 75 (via cold water conduit 77) and a separate valve which is in fluid communication with the hot water source 76 (via hot water conduit 78). In either case, the valve or valves may selectively allow or prevent hot water from hot water source 76 and cold water from cold water source 75 therethrough, such as for particular times or at particular ratios, to adjust the temperature of the water that is flowed to and through nozzle 72 into the tub 64.

An additive dispenser 84 may additionally be provided for directing a wash additive, such as detergent, bleach, liquid fabric softener, etc., into the tub 64. For example, dispenser 84 may be in fluid communication with nozzle 72 such that water flowing through nozzle 72 flows through dispenser 84, mixing with wash additive at a desired time during operation to form a liquid or wash fluid, before being flowed into tub 64. In some embodiments, nozzle 72 is a separate downstream component from dispenser 84. In other embodiments, nozzle 72 and dispenser 84 may be integral, with a portion of dispenser 84 serving as the nozzle 72. A pump assembly 90 (shown schematically in FIGS. 2 and 3) is located beneath tub 64 and basket 70 for gravity assisted flow to drain tub 64.

An agitator or agitation element 92 (shown as an impeller in FIG. 2 and as an extended agitator post in FIG. 3) may be disposed in basket 70 to impart an oscillatory motion to articles and liquid in chamber 73 of basket 70. In various exemplary embodiments, agitation element 92 includes a single action element (i.e., oscillatory only), double action (oscillatory movement at one end, single direction rotation at the other end) or triple action (oscillatory movement plus single direction rotation at one end, single direction rotation at the other end). As generally illustrated in FIGS. 2 and 3, agitation element 92 is oriented to rotate about an axis parallel to the vertical direction V (e.g., central axis 69). Alternatively, basket 70 may provide such agitating movement, and agitation element 92 is not required. Basket 70 and agitation element 92 are driven by a motor 94. Motor 94 may, for example, be a pancake motor, direct drive brushless motor, induction motor, or other motor suitable for driving basket 70 and agitation element 92. As motor output shaft 98 is rotated, basket 70 and agitation element 92 are operated for rotatable movement within tub 64 (e.g., about central axis 69). Washing machine appliance 50 may also include a brake assembly (not shown) selectively applied or released for respectively maintaining basket 70 in a stationary position within tub 64 or for allowing basket 70 to spin within tub 64.

Operation of washing machine appliance 50 is controlled by a processing device or controller 100, that is operatively coupled to the input selectors 60 located on washing machine backsplash 56 (shown in FIG. 1) for user manipulation to select washing machine cycles and features. Controller 100 may further be operatively coupled to various other components of appliance 50, such as valve assembly 74, pump assembly 90, motor 94, and one or more suitable sensors, etc. In response to user manipulation of the input selectors 60, controller 100 may operate the various components of washing machine appliance 50 to execute selected machine cycles and features.

Controller 100 may include a memory (e.g., non-transitive media) and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor (e.g., using a combination of discrete analog or digital logic circuitry, such as switches, amplifiers, integrators, comparators, flip-flops, AND gates, and the like) to perform control functionality instead of relying upon software. Control panel 58 and other components of washing machine appliance 50 may be in communication with controller 100 via one or more signal lines or shared communication busses.

In an illustrative embodiment, a load of laundry articles are loaded into chamber 73 of basket 70, and washing operation is initiated through operator manipulation of control input selectors 60. Tub 64 is filled with liquid, such as water, and may be mixed with detergent to form a wash fluid. Valve assembly 74 can be opened to initiate a flow of liquid and resulting wash fluid into tub 64 via nozzle 72, and tub 64 can be filled to the appropriate level for the amount of articles being washed. Once tub 64 is properly filled with wash fluid, the contents of the basket 70 are agitated with agitation element 92 or by movement of the basket 70 for cleaning of articles in basket 70 (e.g., as part of an agitation phase of a wash cycle). More specifically, agitation element 92 or basket 70 is moved back and forth in an oscillatory motion.

After the agitation phase of the wash cycle is completed, tub 64 is drained, such as through use of pump assembly 90. Laundry articles can then be rinsed by again adding fluid to tub 64. Depending on the particulars of the cleaning cycle selected by a user, agitation element 92 or basket 70 may again provide agitation within basket 70. After a rinse cycle, tub 64 is again drained, such as through use of pump assembly 90. Further, in exemplary embodiments, one or more spin cycles may be performed. In particular, a spin cycle may be applied after the wash cycle(s) or after the rinse cycle(s) in order to wring excess wash fluid from the articles being washed. During a spin cycle, basket 70 is rotated at relatively high speeds, as discussed further herein.

While described in the context of specific embodiments of washing machine appliance 50, using the teachings disclosed herein it will be understood that washing machine appliance 50 is provided by way of example only. Other washing machine appliances having different configurations, different appearances, or different features may also be utilized with the present subject matter as well.

In some embodiments, a partition assembly 200 is provided within wash chamber 73. Generally, the partition assembly 200 includes a plurality of fluid guides 210 and a partition plate 212. The partition plate 212 is movably mounted within the basket 70 to rest above the bottom wall 70B (e.g., to be selectively removed from the wash chamber 73). As shown, each of the plurality of fluid guides 210 generally extends along the sidewall 70A of the wash basket 70 below the partition plate 212. As will be described in detail below, the fluid guides 210 may support the partition plate 212 within the wash basket 70 (see FIG. 2). In some such embodiments, the partition plate 212 and fluid guides 210 are fixed to the wash basket 70 and, thus, rotate therewith. Additionally or alternatively, the partition plate 212 may be fixed to the agitation element 92 (see FIG. 3). Thus, the partition plate 212 may pivot or rotate with the agitation element 92.

Generally, the partition plate 212 may be selectively placed within the wash chamber 73 and removed therefrom. When the partition plate 212 is removed from (or otherwise positioned outside of) the wash chamber 73, one or more articles (e.g., durable articles) may be placed within the wash basket 70. When the partition plate 212 is mounted or placed within the wash chamber 73, the partition plate 212 may support one or more articles (e.g., delicate articles) thereon. Thus, the mounted partition plate 212 and the wash basket 70 may define a first sub-chamber 218 below the partition plate 212 (e.g., along the vertical direction V between partition plate 212 and bottom wall 70B) and a second sub-chamber 220 above the partition plate 212 (e.g., along the vertical direction V directly above partition plate 212).

Turning now to FIGS. 4 through 13, an exemplary embodiment of the partition assembly 200 will be described in greater detail. It is understood that, except as otherwise indicated, other exemplary embodiments may include one or more modifications, additional features, alternate features, or omissions without departing from the present subject matter.

As shown, the partition plate 212 generally defines an upper support surface 224 and a lower restrictor surface 226 opposite of the upper support surface 224. Generally, both surfaces may extend radially outward from a central axis 69 parallel to the vertical direction V (e.g., when mounted within the wash basket 70). However, as illustrated, the surfaces 224, 226 need not be perfectly planar. A suitable curved or arcuate shape may be defined along the upper support surface 224 or lower restrictor surface 226. When the partition plate 212 is mounted to the wash basket 70, a perimeter or radial edge 228 (e.g., along which the upper support surface 224 and lower restrictor surface 226 meet) may engage the inner surface of the sidewall 70A of the wash basket 70. For instance, the radial edge 228 of the partition plate 212 may contact (e.g., directly or through an intermediate member) the inner surface of the sidewall 70A. Thus, articles (e.g., delicate articles) may be placed on the upper support surface 224 within the second sub-chamber 220 and prevented from falling below the partition plate 212 into the first sub-chamber 218. In certain embodiments, one or more perimeter notches 230 are defined at the radial edge 228. As shown, the perimeter notches 230 provide a space or gap between a portion of the radial edge 228 of the partition plate 212 through which wash fluid may pass (e.g., between the upper support surface 224 and the lower restrictor surface 226). Moreover, multiple perimeter notches 230 may be circumferentially spaced apart from each other about the central axis 69, as shown.

Between the upper support surface 224 in the lower restrictor surface 226, partition plate 212 defines a plurality of apertures 234. In particular, each aperture 234 extends (e.g., along the vertical direction V) through the partition plate 212 from the upper support surface 224 to the lower restrictor surface 226. Thus, the apertures 234 can generally permit fluid communication (e.g., of wash fluid) between the first sub-chamber 218 to the second sub-chamber 220. Each aperture 234 may define an identical or, alternatively, unique radial diameter (e.g., between 0.25 inch and 2 inches). Moreover, each radial diameter may be constant or, alternatively, a variable diameter that is tapered (e.g., along the vertical direction V).

As shown, each of the apertures 234 may be generally located at a radial position between the radial edge 228 and the central axis 69. In some embodiments, the apertures 234 are defined in a predetermined array. Multiple apertures 234 may be circumferentially spaced apart from each other about the central axis 69. Additionally or alternatively, multiple apertures 234 may be radially spaced apart from each other (e.g., outward from the central axis 69). Thus, multiple circular rows and radial columns may be defined by the predetermined array of the apertures 234. Optionally, some or all of the apertures 234 may be positioned proximal to the central axis 69 and distal to the radial edge 228 (i.e., closer to the central axis 69 than the radial edge 228 along the radial direction R).

In certain embodiments, one or more vertical vanes 236 extend from the upper support surface 224 of the partition plate 212. When the partition plate 212 is mounted within the wash basket 70, the vertical vanes 236 may thus extend upward into the second sub-chamber 220. For instance, multiple vertical vanes 236 may extend radially outward from the central axis 69. In some such embodiments, the vertical height of each vane 236 (e.g., relative to the upper support surface 224) decreases along the radial direction R from a peak at the central axis 69. During wash operations, the vertical vanes 236 may gently motivate or push articles on the upper support surface 224 (e.g., as the partition plate 212 pivots or rotates). Optionally, the vertical vanes 236 may be integrally formed with the rest of the partition plate 212 (i.e., as a unitary monolithic unit). Alternatively, the vertical vanes 236 may be discrete members attached to upper support surface 224 via one or more suitable adhesives or mechanical connectors.

As shown, multiple fluid guides 210 are circumferentially spaced apart from each other along the sidewall 70A of the wash basket 70. From the sidewall 70A, each fluid guide 210 may extend radially inward toward the central axis 69. During use (e.g., agitation or spin), the fluid guides 210 may act as baffles, pushing or agitating articles within the wash basket 70 (e.g., within the first sub-chamber 218).

Figure 11:
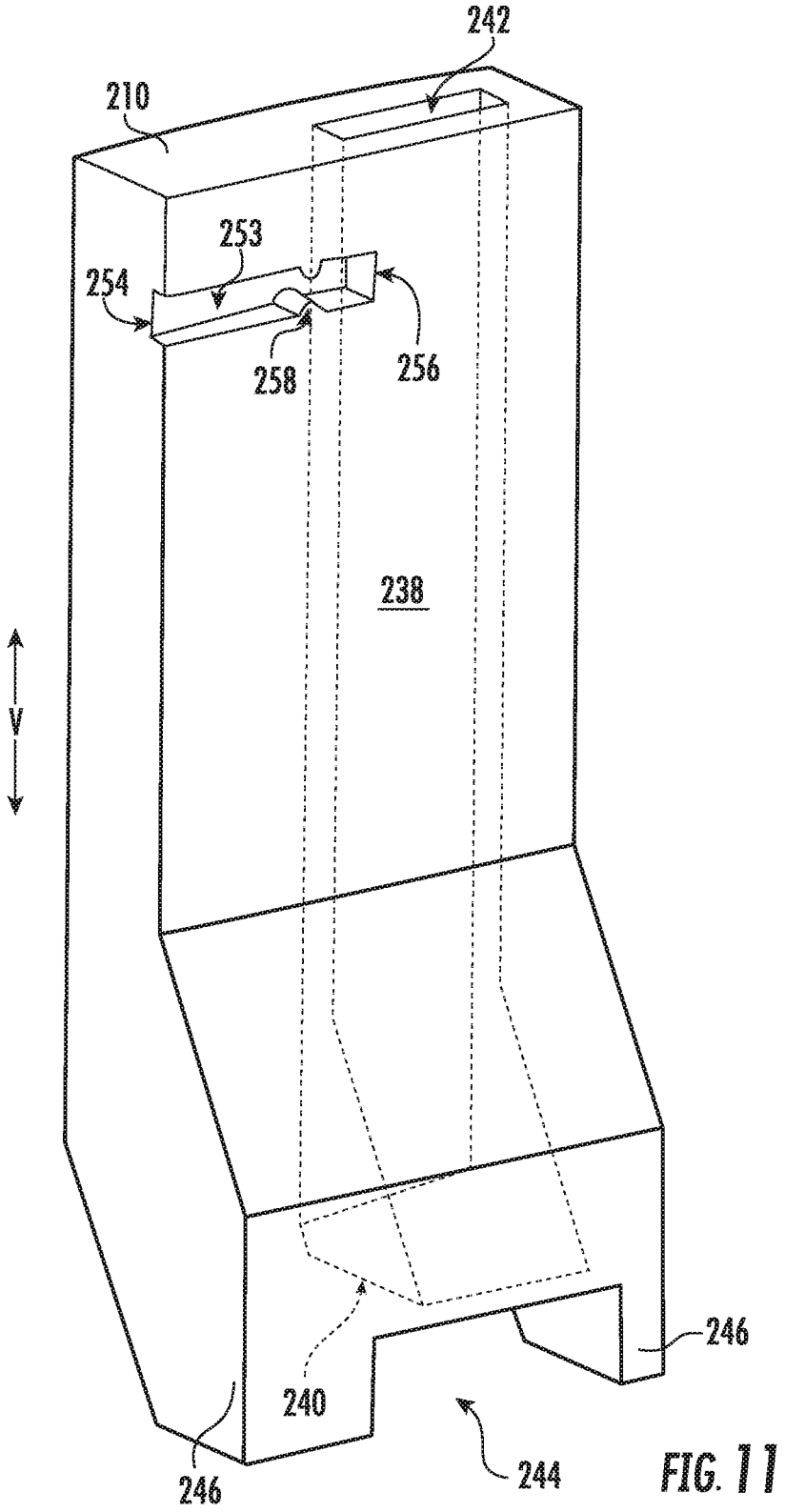
FIG. 11 provides a perspective view of a fluid guide of a washing machine appliance according to exemplary embodiments of the present disclosure.

Turning especially to FIG. 11, an internal fluid passage 238 is defined through a corresponding fluid guide 210. For instance, the internal fluid passage 238 may generally extend along the vertical direction V. In particular, the internal fluid passage 238 extends from an inlet 240 to an outlet 242 positioned above the inlet 240. Thus, a fluid (e.g., wash fluid) may be directed through the internal fluid passage 238, such as from the inlet 240 to the outlet 242. Optionally, a cross-section (e.g., radial cross-section) of the internal fluid passage 238 may be tapered, at least in part, such that the cross-section decreases from the inlet 240 to the outlet 242 (e.g., along the vertical direction V). Alternatively, the cross-section of the internal fluid passage 238 may remain constant between the inlet 240 and the outlet 242 (e.g., along the vertical direction V).

Returning generally to FIGS. 4 through 13, in certain embodiments, the inlet 240 of the internal fluid passage 238 is vertically spaced apart from the bottom wall 70B of the wash basket 70 (e.g., positioned above the bottom wall 70B). The fluid guide 210 and bottom wall 70B may thus define a passage or channel (e.g. radial channel 244) extending below and to the inlet 240 of the internal fluid passage 238. In some such embodiments, one or more base feet 246 extend below the inlet 240 (e.g., at opposite circumferential sides thereof) and defines a radial channel 244 extending along the radial direction R in front of and beneath the inlet 240 of the internal fluid passage 238.

In some embodiments, multiple fluid guides 210 each define a discrete internal fluid passage 238. Optionally, each fluid guide 210 of the partition assembly 200 may define a discrete internal fluid passage 238. When assembled, at least a portion of each internal fluid passage 238 may be aligned with a corresponding perimeter notch 230. In particular, the outlet 242 of the internal fluid passage 238 may be aligned (e.g., along the vertical direction V) with a corresponding perimeter notch 230. During use (e.g., agitation or spin), fluid (e.g. wash fluid) may pass from the first sub-chamber 218, into the internal fluid passage 238 at the inlet 240, to the outlet 242, from the outlet 242 to the perimeter notch 230, and from the perimeter notch 230 into the second sub-chamber 220.

Figure 5:
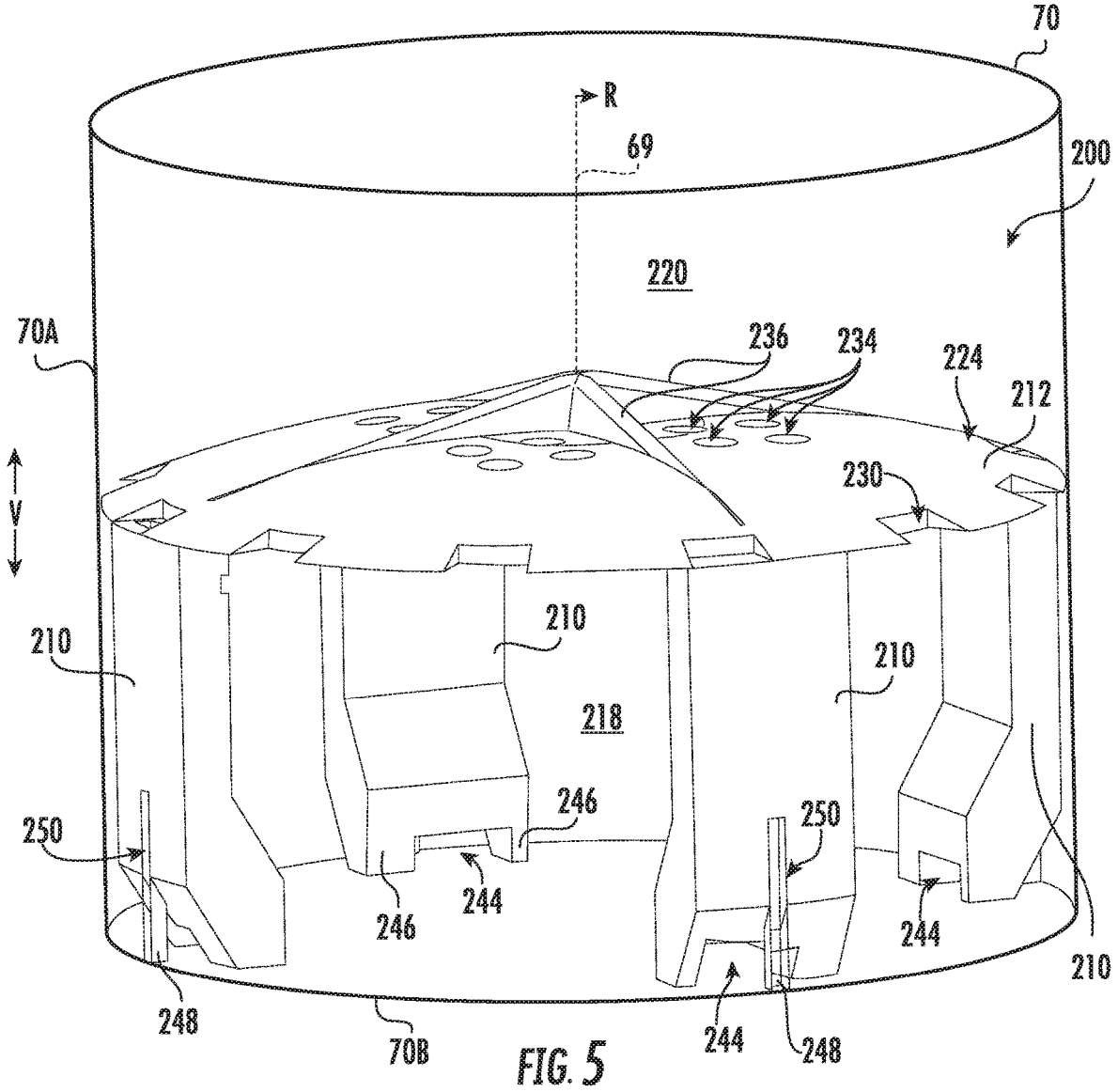
FIG. 5 provides a transparent, side, perspective view of the exemplary tub and partition assembly of FIG. 4.
Figure 6:
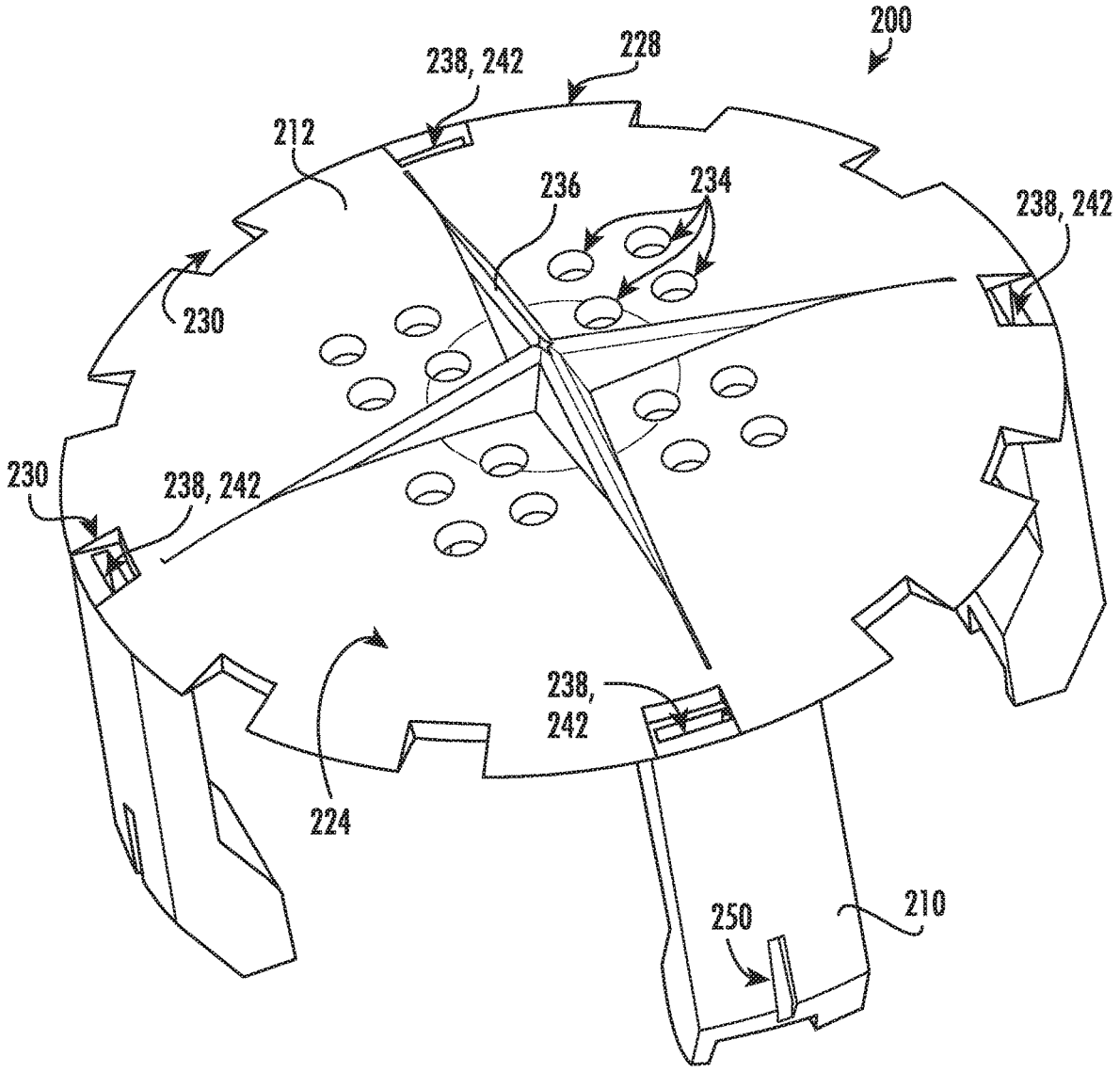
FIG. 6 provides a top perspective view of the exemplary partition assembly of FIG. 4.
Figure 7:
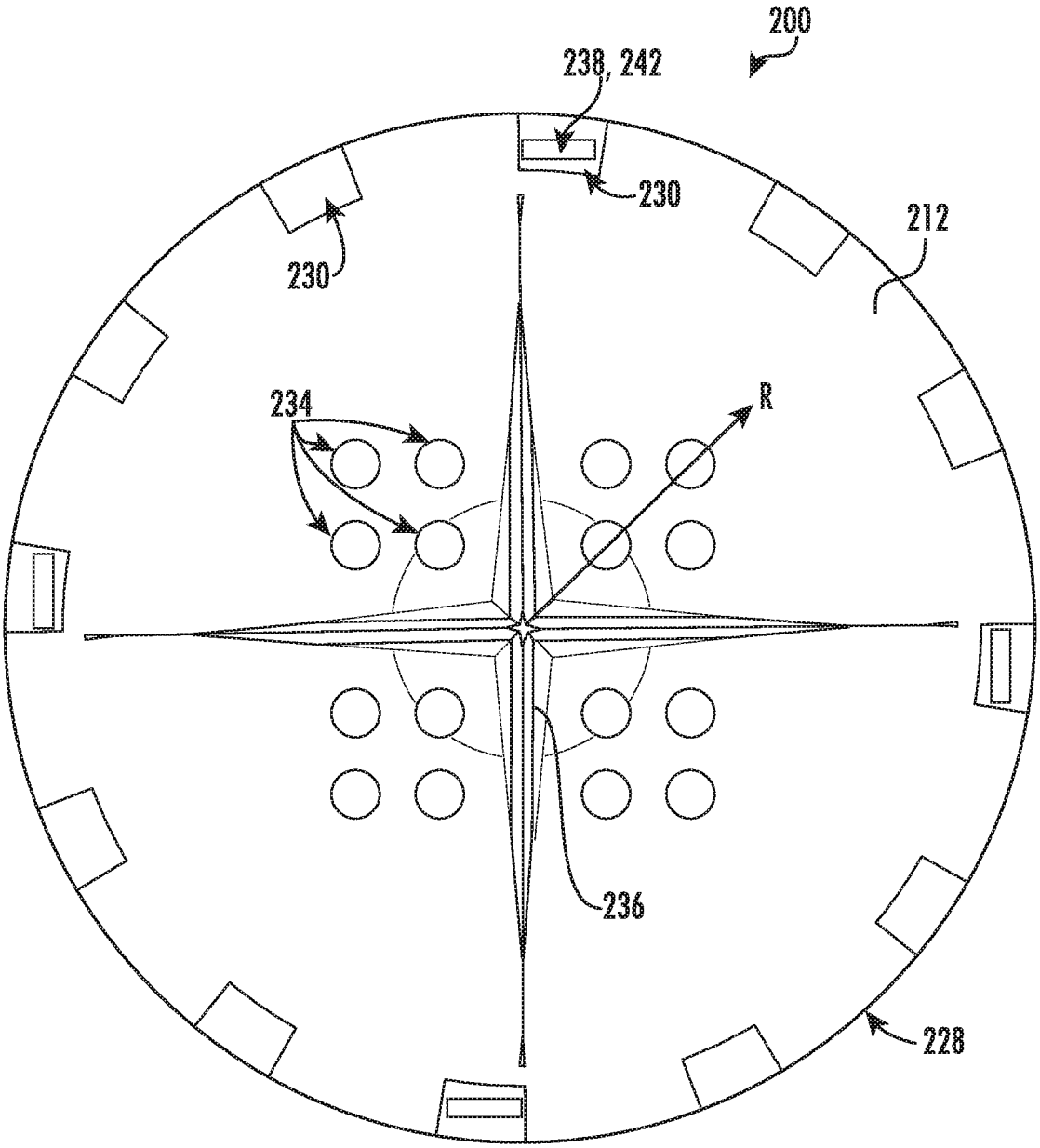
FIG. 7 provides an overhead perspective view of a partition plate of a washing machine appliance according to exemplary embodiments of the present disclosure.
Figure 8:
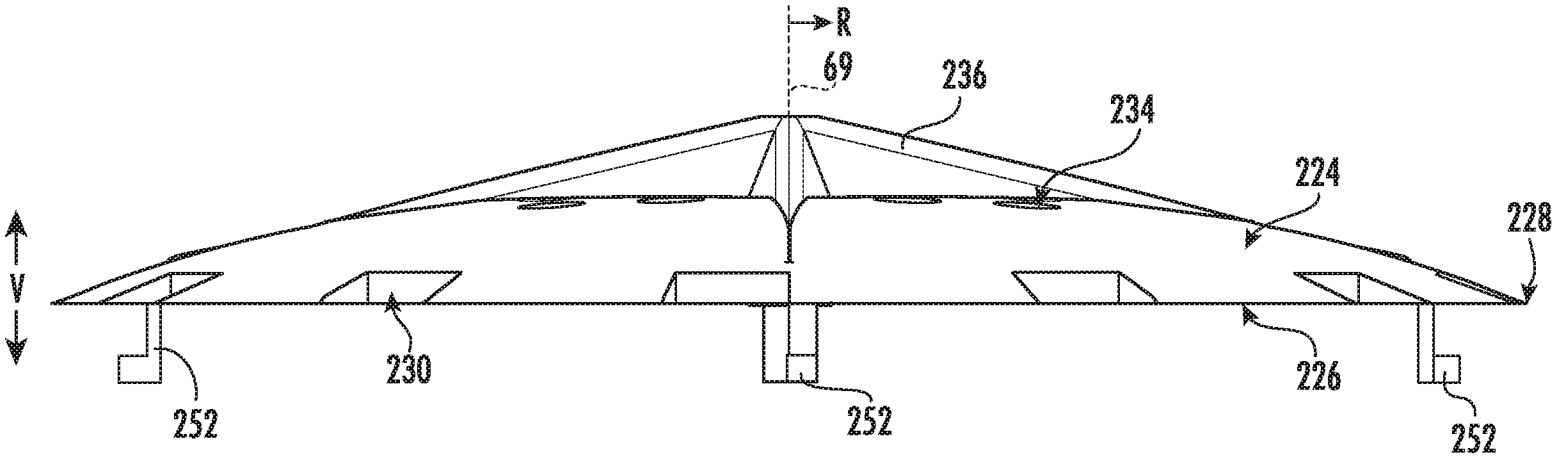
FIG. 8 provides a side perspective view of the exemplary partition plate of FIG. 7.
Figure 9:
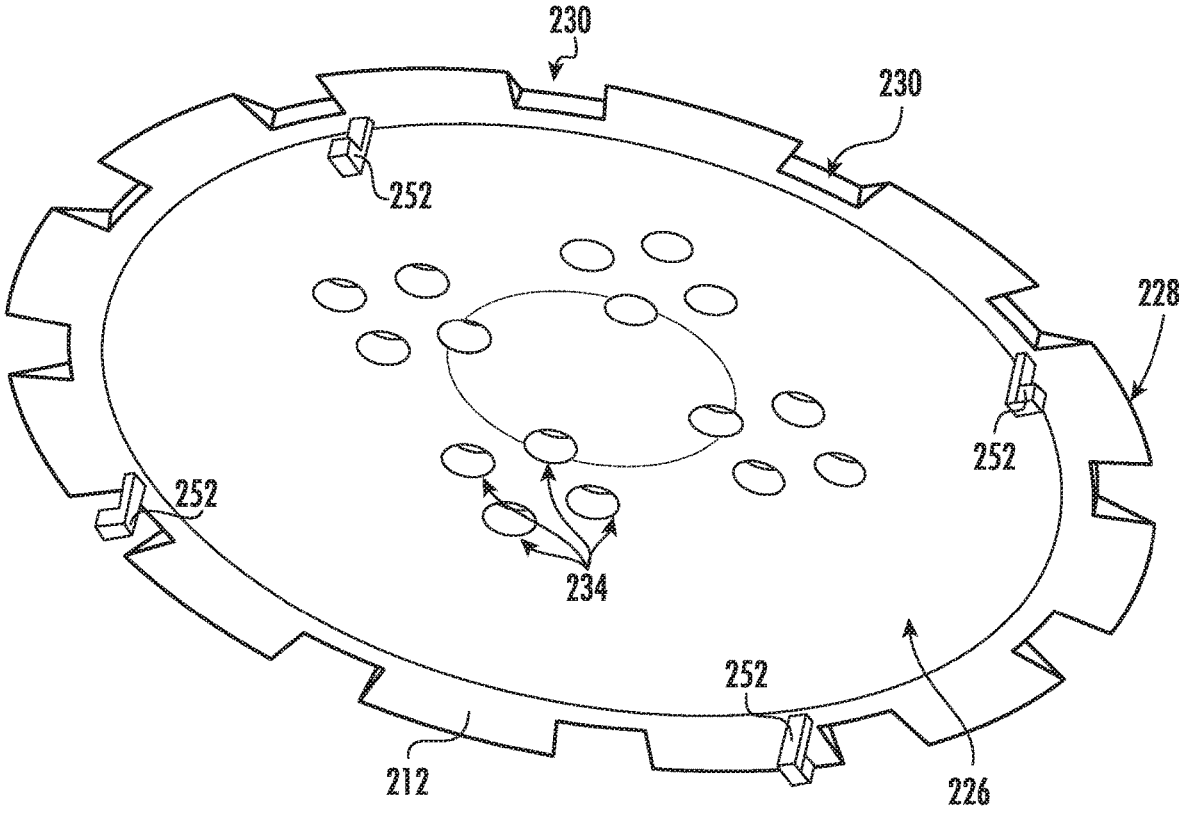
FIG. 9 provides a bottom perspective view of the exemplary partition plate of FIG. 7.
Figure 10:
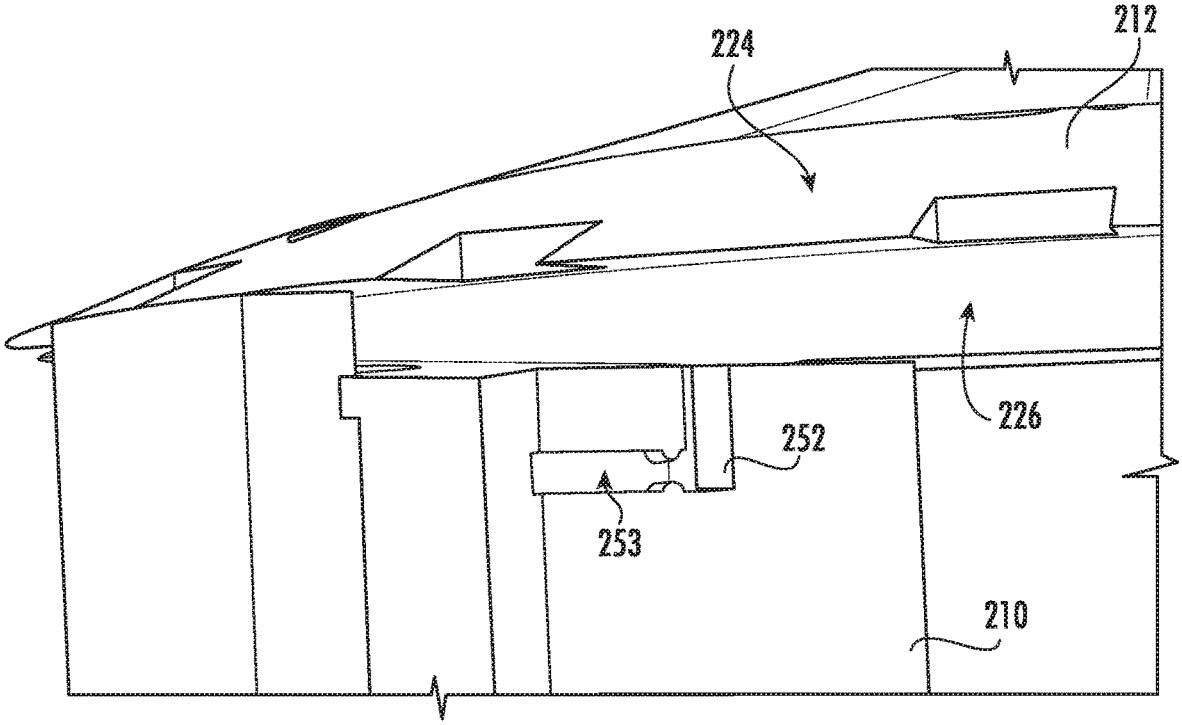
FIG. 10 provides a side perspective view of a portion of a partition assembly of a washing machine appliance according to exemplary embodiments of the present disclosure.
Figure 13:
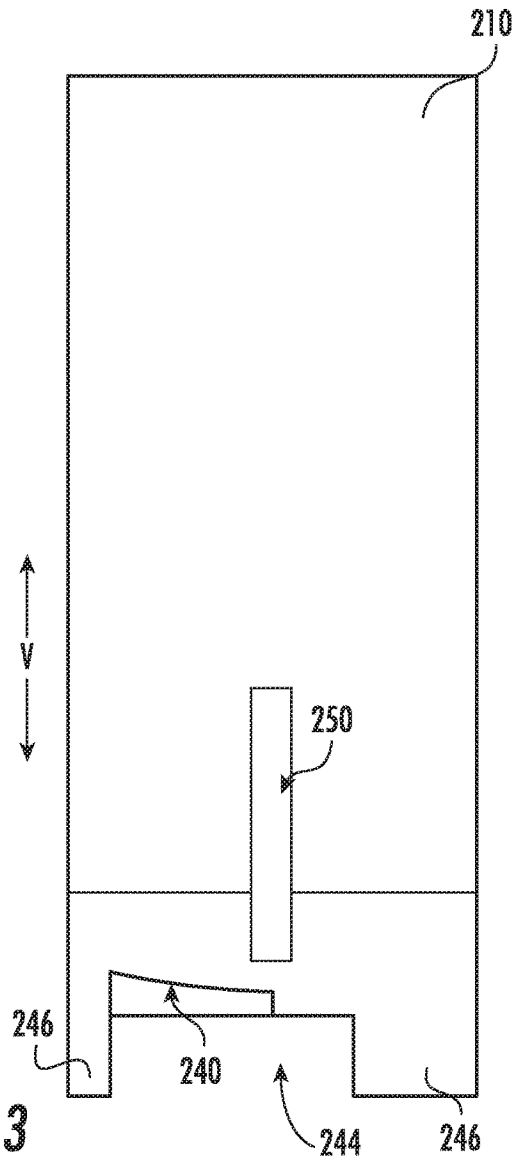
FIG. 13 provides a rear plan view of the exemplary fluid guide of FIG. 11.
Figure 12:
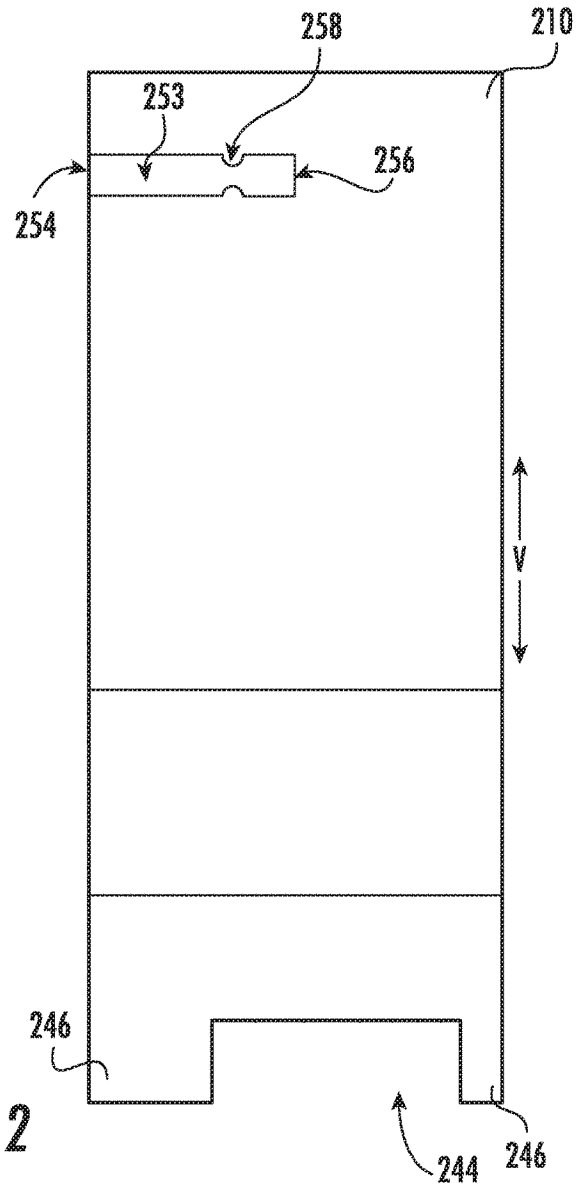
FIG. 12 provides a front plan view of the exemplary fluid guide of FIG. 11.

As shown in FIGS. 5, 6, and 13, a mated connection may be formed between the wash basket 70 and each fluid guide 210. For instance, one or more mated rail-grooves may be provided to secure the fluid guide 210 to the wash basket 70. In some such embodiments, multiple rails 248 are fixed at discrete circumferential locations on the sidewall 70A of the wash basket 70. At least one groove 250 is defined in the outer surface of each fluid guide 210. When assembled, each groove 250 may receive a corresponding rail 248, thereby supporting a fluid guide 210 on the wash basket 70.

Turning especially to FIGS. 8 through 11, in some embodiments, partition plate 212 is selectively fixed to a plurality of fluid guides 210, as noted above. In some such embodiments, a mated tab-slot connection is formed between partition plate 212 and one or more of the fluid guides 210. For instance, one or more radial tabs 252 may extend from the partition plate 212. One or more corresponding circumferential slots 253 defined by the fluid guides 210 may receive the radial tabs 252.

In certain embodiments, multiple L-shaped radial tabs 252 extend from the lower restrictor surface 226. As shown, a portion of each radial tab 252 may extend along the vertical direction V from the lower restrictor surface 226 before extending radially outward (e.g., from the central axis 69 or toward the sidewall 70A of wash basket 70).

Below the outlet 242 and the upper support surface 224 of the partition plate 212, one or more of the fluid guides 210 may define a circumferential slot 253. As shown, each circumferential slot 253 extends generally along a circumferential direction from an open end 254 to a closed end 256. In particular, each circumferential slot 253 may be defined in the inner surface of the corresponding fluid guide 210. A tapered neck 258 may be defined between the open end 254 and the closed end 256, thereby restricting the size or cross-section of a portion of the circumferential slot 253. When assembled, the circumferential slot 253 may thus receive a portion (e.g., the radially outward portion) of a radial tab 252. The radial tab 252 may be rotated relative to the fluid guide 210 such that the radial tab 252 passes from the open end 254 of the circumferential slot 253, past the tapered neck 258, and to the closed end 256. During use, to the tapered neck 258 and closed end 256 may generally restrict circumferential movement of the radial tab 252 and partition plate 212 relative to the fluid guides 210.

Figure 14:
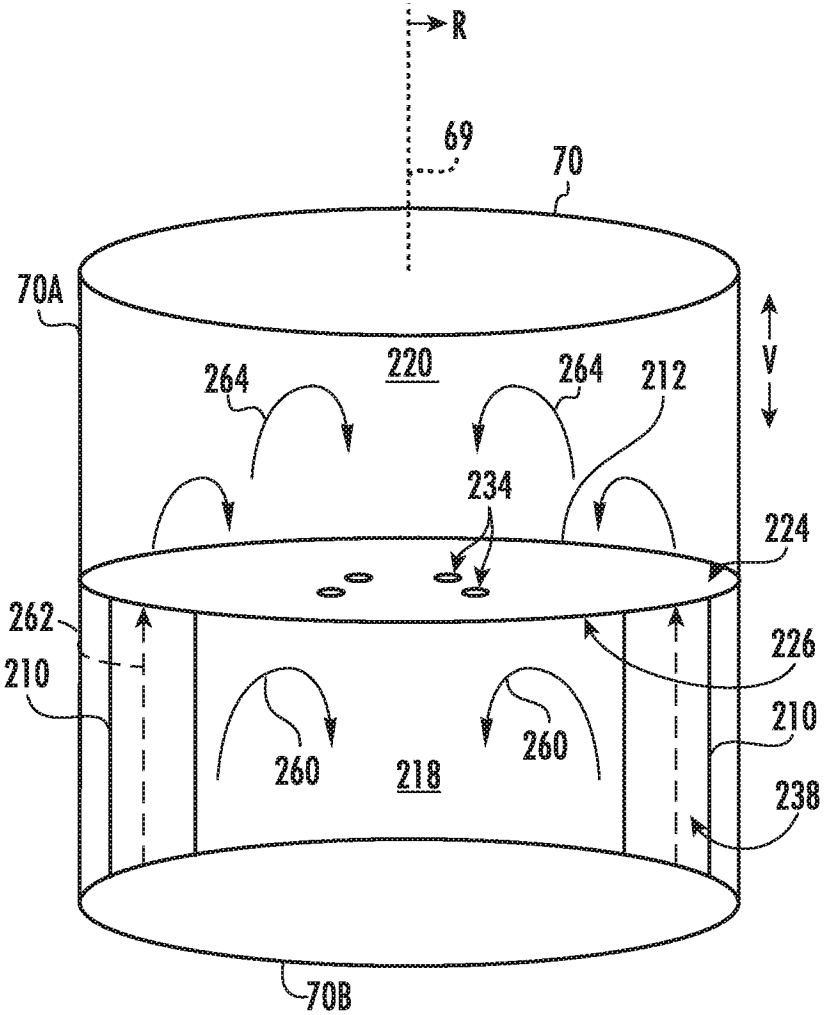
FIG. 14 provides a schematic view of a tub and partition assembly of a washing machine appliance according to exemplary embodiments of the present disclosure.

As shown in FIG. 14, during use, separate fluid flows may be generated within the wash basket 70. For instance, oscillation (e.g., during agitation) or rotation (e.g., during a spin cycle) may generate a primary fluid flow (e.g., as indicated by arrows 260) within the first sub-chamber 218. Wash fluid may be forced outward against the sidewall 70A of the wash basket 70 before the partition plate 212 forces at least some of the wash fluid downward to the bottom wall 70B. Some of the wash fluid may travel through the fluid guides 210 and to the second sub-chamber 220 (e.g., as indicated at arrows 262). Wash fluid within the second sub-chamber 220 may generate a relatively weak secondary fluid flow (e.g., as indicated at arrows 264) when compared to the primary fluid flow. From the second sub-chamber 220, some of the wash fluid may be returned to the first sub-chamber 218 (e.g., through the apertures 234).

Advantageously, relatively delicate articles may be suitably treated and washed in the second sub-chamber 220 while relatively durable articles are suitably treated and washed in the first sub-chamber 218 (e.g., during the same wash cycle or operation).

Figure 15:
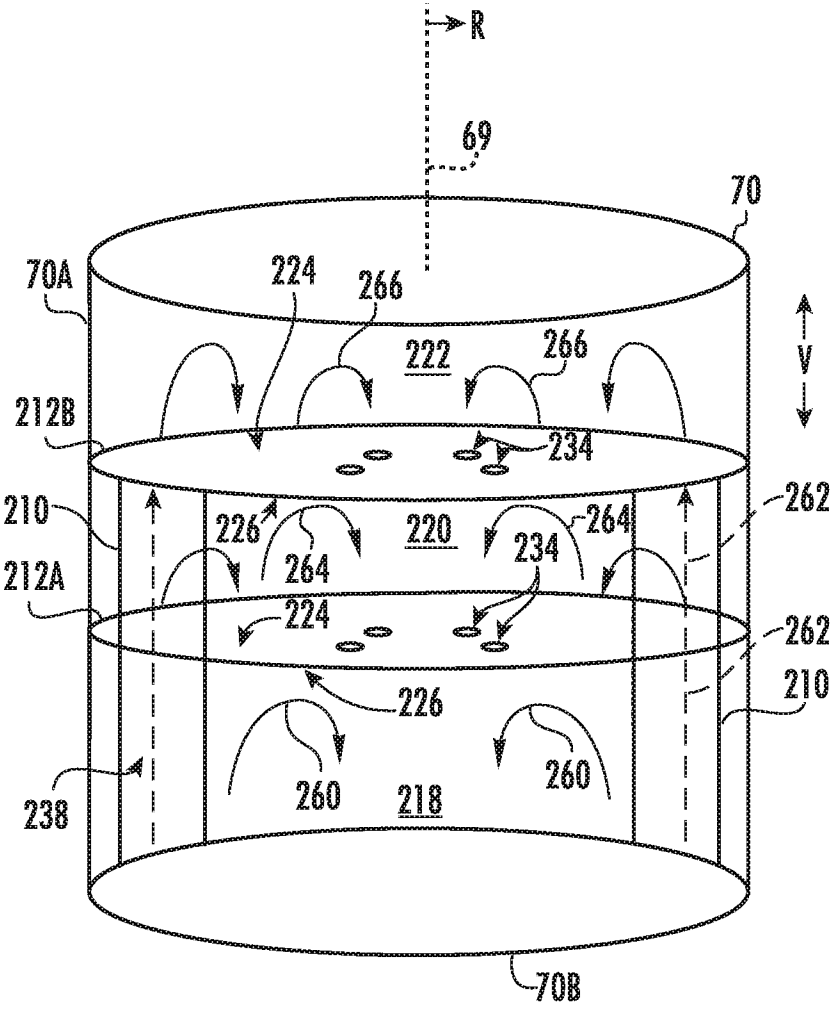
FIG. 15 provides a schematic view of a tub and partition assembly of a washing machine appliance according to other exemplary embodiments of the present disclosure.

Turning now to FIG. 15, is understood that in some embodiments, multiple partition plates 212 may be provided at discrete vertical locations. For instance, a first partition plate 212A may be provided above the bottom wall 70B of the wash basket 70. A second partition plate 212B may be provided above the first partition plate 212A, such that a third sub-chamber 222 is defined above the second partition plate 212B. In some such embodiments, at least one of the fluid guides 210 defines an internal fluid passage 238 that extends vertically in fluid communication between the first sub-chamber 218 and the third sub-chamber 222. Each of the first and second partition plates 212A, 212B may be supported on the same fluid guides 210 or, alternatively, on different fluid guides 210.

During use, separate fluid flows may be generated within the wash basket 70. For instance, oscillation (e.g., during agitation) or rotation (e.g., during a spin cycle) may generate a primary fluid flow (e.g., as indicated by arrows 260) within the first sub-chamber 218. Wash fluid may be forced outward against the sidewall 70A of the wash basket 70 before the first partition plate 212A forces at least some of the wash fluid downward to the bottom wall 70B. Some portions of the wash fluid may travel through the fluid guides 210 and to the second sub-chamber 220 (e.g., as indicated at arrows 262). Wash fluid within the second sub-chamber 220 may generate a relatively weak secondary fluid flow (e.g., as indicated at arrows 264) when compared to the primary fluid flow. At least a portion of the secondary fluid flow may be forced downward by the second partition plate 212B and toward the first partition plate 212A. From the second sub-chamber 220, some of the wash fluid may be returned to the first sub-chamber 218 (e.g., through the apertures 234 defined by the first partition plate 212A). Other portions of the wash fluid may travel through the fluid guides 210 and to the third sub-chamber 222 (e.g., as indicated at arrows 262). Wash fluid within the second sub-chamber 220 may generate a relatively weak tertiary fluid flow (e.g., as indicated at arrows 266). The tertiary fluid flow may be weaker than both the secondary fluid flow and the primary fluid flow. From the third sub-chamber 222, some of the wash fluid may be returned to the second or first sub-chambers 220, 218 (e.g., through the apertures 234 defined by the second partition plate 212B).

Advantageously, relatively delicate articles may be suitably treated and washed in the third sub-chamber 222, while mixed or moderately durable articles are suitably treated and washed in the second sub-chamber 220 and relatively durable articles suitably treated washed in the first sub-chamber 218 (e.g., during the same wash cycle or operation).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance, comprising:

a cabinet;

a tub disposed within the cabinet;

a basket rotatably mounted within the tub, the basket comprising a bottom wall and a sidewall defining a chamber for receipt of a load of items for washing;

a partition plate movably mounted above the bottom wall within the basket, the partition plate defining a first sub-chamber below the partition plate and a second sub-chamber above the partition plate; and a plurality of fluid guides extending along the sidewall below the partition plate within the first sub-chamber, wherein one or more fluid guide of the plurality of fluid guides defines an internal fluid passage extending within the basket from an inlet positioned above the bottom wall of the basket to an outlet positioned above the inlet, wherein the one or more fluid guide of the plurality of fluid guides comprises a pair of base feet extending below the inlet to the bottom wall of the basket, and wherein the pair of base feet define a radial channel upstream from the inlet, the radial channel extending in front of and below the internal fluid passage.

2. The washing machine appliance of claim 1, wherein the partition plate defines a plurality of apertures extending through the partition plate in fluid communication between the first sub-chamber and the second sub-chamber.

3. The washing machine appliance of claim 1, wherein the partition plate comprises an upper support surface extending across the chamber, and a vertical vane extending from the upper support surface within the second sub-chamber.

4. The washing machine appliance of claim 1, wherein the internal fluid passage extends vertically in fluid communication between the first sub-chamber and the second sub-chamber.

5. The washing machine appliance of claim 1, wherein the partition plate defines a plurality of perimeter notches circumferentially spaced apart at a perimeter of the partition plate.

6. The washing machine appliance of claim 5, wherein the outlet is vertically-aligned within at least one notch of the plurality of perimeter notches.

7. The washing machine appliance of claim 1, wherein the partition plate is selectively fixed to the plurality of fluid guides.

8. The washing machine appliance of claim 1, further comprising an agitator extending from the bottom wall, wherein the partition plate is selectively fixed to the agitator.

9. The washing machine appliance of claim 1, wherein the partition plate is a first partition plate, wherein the washing machine appliance comprises a second partition plate movably mounted above the first partition plate within the basket, and wherein the second partition plate defines a third sub-chamber above the second partition plate.

10. The washing machine appliance of claim 9, wherein the internal fluid passage extends vertically in fluid communication between the first sub-chamber and the third sub-chamber.

11. A washing machine appliance, comprising:

a cabinet;

a tub disposed within the cabinet;

a basket rotatably mounted within the tub, the basket comprising a bottom wall and a sidewall defining a chamber for receipt of a load of items for washing;

a partition plate movably mounted above the bottom wall within the basket, the partition plate defining a first sub-chamber below the partition plate and a second sub-chamber above the partition plate; and a plurality of fluid guides extending along the sidewall below the partition plate within the first sub-chamber, the plurality of fluid guides defining a plurality of discrete internal fluid passages extending vertically in fluid communication between the first sub-chamber and the second sub-chamber, wherein one or more fluid guide of the plurality of fluid guides defines an internal fluid passage extending within the basket from an inlet positioned above the bottom wall of the basket to an outlet positioned above the inlet, wherein the one or more fluid guide of the plurality of fluid guides comprises a pair of base feet extending below the inlet to the bottom wall of the basket, and wherein the pair of base feet define a radial channel upstream from the inlet, the radial channel extending in front of and below the internal fluid passage.

12. The washing machine appliance of claim 11, wherein the partition plate defines a plurality of apertures extending through the partition plate in fluid communication between the first sub-chamber and the second sub-chamber.

13. The washing machine appliance of claim 11, wherein the partition plate comprises an upper support surface extending across the chamber, and a vertical vane extending from the upper support surface within the second sub-chamber.

14. The washing machine appliance of claim 11, wherein the partition plate is selectively fixed to the plurality of fluid guides.

15. The washing machine appliance of claim 11, further comprising an agitator extending from the bottom wall, wherein the partition plate is selectively fixed to the agitator.

16. The washing machine appliance of claim 11, wherein the partition plate defines a plurality of perimeter notches circumferentially spaced apart at a perimeter of the partition plate.

17. The washing machine appliance of claim 16, wherein the outlet is vertically-aligned within a corresponding notch of the plurality of perimeter notches.

18. The washing machine appliance of claim 11, wherein the partition plate is a first partition plate, wherein the washing machine appliance comprises a second partition plate movably mounted above the first partition plate within the basket, and wherein the second partition plate defines a third sub-chamber above the second partition plate.

19. The washing machine appliance of claim 18, the internal-fluid passage extends vertically in fluid communication between the first sub-chamber and third sub-chamber.

20. A washing machine appliance, comprising:

a cabinet;

a tub disposed within the cabinet;

a basket rotatably mounted within the tub, the basket comprising a bottom wall and a sidewall defining a chamber for receipt of a load of items for washing;

a partition plate movably mounted above the bottom wall within the basket, the partition plate defining a first sub-chamber below the partition plate and a second sub-chamber above the partition plate; and a plurality of fluid guides extending along the sidewall below the partition plate within the first sub-chamber, wherein one or more fluid guide of the plurality of fluid guides defines an internal fluid passage extending within the basket from an inlet positioned above the bottom wall of the basket to an outlet positioned above the inlet, wherein the one or more fluid guide of the plurality of fluid guides comprises a pair of base feet extending below the inlet to the bottom wall of the basket, wherein the pair of base feet define a radial channel upstream from the inlet, the radial channel extending in front of and below the internal fluid passage, and wherein a mated rail-groove connection is formed between the sidewall and the one or more fluid guide of the plurality of fluid guides rearward from the internal fluid passage.

* * * * *